US007230370B2

(12) United States Patent
Kato

(10) Patent No.: US 7,230,370 B2
(45) Date of Patent: Jun. 12, 2007

(54) SPARK PLUG

(75) Inventor: Tomoaki Kato, Nagoya (JP)

(73) Assignee: NGK Spark Plug Co, Ltd., Aichi (JP)

( * ) Notice: Subject to any disclaimer, the term of this patent is extended or adjusted under 35 U.S.C. 154(b) by 189 days.

(21) Appl. No.: 11/013,355

(22) Filed: Dec. 17, 2004

(65) Prior Publication Data

US 2005/0184633 A1 Aug. 25, 2005

(30) Foreign Application Priority Data

Dec. 19, 2003 (JP) ..... P. 2003-422770

(51) Int. Cl.
*H01T 13/20* (2006.01)

(52) U.S. Cl. ..... 313/141; 313/140

(58) Field of Classification Search ..... 313/118, 313/140–142

See application file for complete search history.

(56) References Cited

U.S. PATENT DOCUMENTS

2002/0067111 A1* 6/2002 Shibata et al. ..... 313/141

2003/0085643 A1* 5/2003 Matsubara ..... 313/141

* cited by examiner

*Primary Examiner*—Nimeshkumar D. Patel
*Assistant Examiner*—Anthony Perry
(74) *Attorney, Agent, or Firm*—Sughrue Mion, PLLC

(57) ABSTRACT

A spark plug including an insulator having an axial hole in an axial direction of the spark plug; a center electrode disposed in a tip end side of the axial hole of the insulator; a metal shell surrounding the insulator; a first ground electrode including a first ground electrode body having one end joined to the metal shell, and a noble metal tip joined to an inner side face of another end portion of the first ground electrode body and disposed opposite a tip end face of the center electrode across a first discharge gap. One end of the second ground electrode is bonded to the metal shell, and the another end is disposed opposite a side peripheral face of said center electrode or a side peripheral face of said insulator across a second discharge gap. Furthermore, the spark plug is characterized as having a distance t and an included angle θ as defined herein.

9 Claims, 5 Drawing Sheets

SPARK PLUG

BACKGROUND OF THE INVENTION

1. Field of the Invention

The present invention relates to a spark plug used for providing ignition of an internal combustion engine.

2. Description of the Related Art

A known spark plug for providing ignition of an internal combustion engine such as an automotive engine, comprises: an insulator having an axial hole in the axial direction of the spark plug, a center electrode disposed in a tip end side of the axial hole of the insulator; a metal shell surrounding the insulator; a first ground electrode in which one end is bonded to the metal shell and another end portion opposes a tip end face of the center electrode; and a second ground electrode in which one end is bonded to the metal shell, and another end opposes a side peripheral face of the center electrode or that of the insulator. In such a spark plug, spark discharge is caused in a first discharge gap formed by the center electrode and the first ground electrode to ignite an air-fuel mixture. On the other hand, carbon or the like may adhere to the tip end face of the insulator to result in so-called "fouling." In this case, spark discharge creeping on the surface of the insulator occurs in a second discharge gap which is formed by the second ground electrode and the side peripheral face of the center electrode. Therefore, the contaminant is burned out, so that an anti-contamination property can be attained (for example, see JP-A-2001-237045).

Recently, the demand for further enhancing the performance of an engine is increasing, and there is a need to further improve the ignitability of a spark plug. In a spark plug in which only a first ground electrode is disposed (a second ground electrode is not disposed), the method described below is effective in improving the ignitability. A method in which, in a noble metal tip (precious metal tip) joined to an inner side face of the another end portion of a first ground electrode body, the distance in the axial direction between a face opposing the center electrode and the inner side face (hereinafter, also referred to as protrusion amount) is increased, is also effective. The reason is as follows. A flame kernel produced in a first discharge gap which is formed by the center electrode and the first ground electrode is caused to grow by swirling or the like. When the protrusion amount of the noble metal tip is small, however, the distance between the first discharge gap and the first ground electrode body is so small that, in an early stage of the growing process of the flame kernel, the flame kernel makes contact with the first ground electrode body. As a result, the growth of the flame kernel may be impeded (hereinafter, this is also referred to as a flame quenching effect). Therefore, a structure in which the protrusion amount of a noble metal tip is made as large as possible so as to expedite growth of a flame kernel is often employed.

In order to further improve the ignitability, the inventors have studied a configuration in which a noble metal tip having a larger protrusion amount is joined to the first ground electrode body of the spark plug of JP-A-2001-237045. However, the spark plug of JP-A-2001-237045 has a structure in which, although having a second ground electrode, a flame kernel makes contact with the second ground electrode when the flame kernel grows. Therefore, there is a possibility that the flame quenching effect will impede the growth of the flame kernel. Also in the first ground electrode body in which the noble metal tip protrudes by a large amount, moreover, there is a possibility that, when the flame kernel further grows to exceed the above-mentioned state, the growth of the flame kernel is impeded. As a result, a problem arises in that ignitability cannot be sufficiently ensured.

SUMMARY OF THE INVENTION

It is therefore an object of the present invention to provide a spark plug which comprises first and second ground electrodes, and which structure prevents the second ground electrode and the body of the first ground electrode, to the extent possible, from making contact with a flame kernel, such that ignitability is sufficiently ensured.

As a result of extensive study by the inventors, the present invention has been achieved which provides a spark plug comprising: an insulator having an axial hole in an axial direction of the spark plug; a center electrode disposed in a tip end side of the axial hole of the insulator, a metal shell surrounding the insulator, a first ground electrode having: a first ground electrode body in which one end is joined to the metal shell; and a noble metal tip which is joined to an inner side face of another end portion of the first ground electrode body, and which opposes a tip end face of the center electrode across a first discharge gap; and a second ground electrode in which one end is bonded to the metal shell, and another end opposes a side peripheral face of the center electrode or a side peripheral face of the insulator across a second discharge gap, a distance t in the axial direction between an opposing face of the noble metal tip which opposes the tip end face of the center electrode, and the inner side face of the first ground electrode body is 0.3 mm or more, and in a virtual section which passes through a center of gravity of the second ground electrode, and which contains an axis of the spark plug, an included angle θ between a virtual line s1 and a virtual line s2 satisfies the following relationship:

$$\theta \geqq 55°,$$

the virtual line s1 passing through a middle point of the first discharge gap on the axis and making contact with the first ground electrode body, the virtual line s2 passing through the middle point of the first discharge gap and making contact with an outer side face of the second ground electrode.

The spark plug of the invention is configured so that the distance t in the axial direction between the opposing face of the noble metal tip and the inner side face of the first ground electrode body which opposes the center electrode is 0.3 mm or more. In this configuration, the noble metal tip protrudes by a large amount from the first ground electrode body. Thus, when a flame kernel produced in the first discharge gap which is formed by the center electrode and the noble metal tip grows as a result of swirling or the like, the possibility of the flame kernel making contact with the first ground electrode body is reduced, and growth of the flame kernel is expedited, whereby ignitability is improved. When the distance t in the axial direction between the opposing face of the noble metal and the inner side face of the first ground electrode body is smaller than 0.3 mm, the effect or preventing a flame kernel from making contact with the first ground electrode body is hardly obtained as described above. By contrast, preferably, the distance t in the axial direction between the opposing face of the noble metal and the inner side face of the first ground electrode body is 1.5 mm or less. When the distance t in the axial direction between the opposing face of the noble metal and the inner side face of the first ground electrode body is larger than 1.5 mm, the heat capacity of the noble metal tip is increased, and the durability of the noble metal tip may be lowered. As used herein, "inner side face" means a face of the first ground electrode body on the side opposing the center electrode.

Even in a spark plug in which a noble metal tip protrudes by a large amount as described above, depending on the arrangement of the second ground electrode, when a flame kernel grows, there is a possibility that the flame kernel will make contact with the second ground electrode to cause a flame quenching effect, thereby impeding growth of the flame kernel. Also in the first ground electrode body in which the noble metal tip protrudes by a large amount, when the flame kernel further grows to exceed the above-mentioned state, there is a possibility that the growth of the flame kernel is impeded. As a result, a problem arises in that ignitability of the spark plug cannot be sufficiently ensured.

Therefore, the spark plug of the invention is configured so that, in a virtual section which passes through a center of gravity of the second ground electrode, and which contains an axis of the spark plug, an included angle θ between a virtual line s1 and a virtual line s2 satisfies the following relationship of $\theta \geqq 55°$, the virtual line s1 passing through a middle point of the first discharge gap on the axis and making contact with the first ground electrode body, the virtual line s2 passing through the middle point of the first discharge gap and making contact with an outer side face of the second ground electrode. In the configuration in which the distance between the first ground electrode body and the second ground electrode is made large as described above, during the growth of a flame kernel produced in the vicinity of the middle point of the first discharge gap, the occurrence of the flame kernel contacting the second ground electrode and the first ground electrode body can be reduced. It is therefore possible to enable the flame kernel to efficiently grow and sufficiently improve the ignitability of the spark plug. When θ is smaller than 55°, the above-mentioned effect of allowing a flame kernel to efficiently grow is hardly obtained. By contrast, θ is preferably set so as not to be larger than 90°. When θ is larger than 90°, a failure such as overheating of the first ground electrode body or a fuel bridge may occur. As used herein, "included angle" means the acute angle formed by the virtual lines s1 and s2 such as that shown in FIG. 2 (the acute angle θ1 in FIG. 2).

In the spark plug of the invention, preferably, the included angle θ between the virtual line s1 and the virtual line s2 is $\theta \geqq 60°$. According to this configuration, the occurrence of a flame kernel contacting the second ground electrode and the first ground electrode body can be further reduced, and it is possible to enable the flame kernel to efficiently grow and more sufficiently improve ignitability of the spark plug.

In the spark plug of the invention, preferably, the first ground electrode body is configured so as to form a chamfered portion containing at least a contact point of an outer peripheral edge of the inner side face and the virtual line s1. According to this configuration, the distance between the first ground electrode body and the second ground electrode can be further increased. During growth of a flame kernel produced in the vicinity of the middle point of the first discharge gap, therefore, the occurrence of the flame kernel contacting the first ground electrode body can be reduced, and it is possible to enable the flame kernel to efficiently grow.

In the spark plug of the invention, preferably, the another end portion of the first ground electrode body contains a contact point with the virtual line s1, and decreases in sectional size as it advances toward the another end. According to this configuration, the distance between the first ground electrode body and the second ground electrode can be further increased. During growth of a flame kernel produced in the vicinity of the middle point of the first discharge gap, therefore, the occurrence of the flame kernel contacting the first ground electrode body can be reduced, and it is possible to enable the flame kernel to efficiently grow. As used herein, "decreases in sectional size" means a tapered shape in which the another end portion is gradually thinned, or denotes a stepwise decrease.

Preferably, the spark plug of the invention is configured so that, in the virtual section, when an included angle θ between a virtual line s3 and the virtual line s2 satisfies the relationship of $\theta \geqq 55°$ (more preferably, $\theta \geqq 60°$), the virtual line s3 passing through a middle point of the first discharge gap on the axis and making contact with the noble metal tip. In the configuration in which the distance between the noble metal tip and the second ground electrode is made large, during growth of a flame kernel produced in the vicinity of the middle point of the first discharge gap, the occurrence of the flame kernel contacting the noble metal tip can be reduced. It is therefore possible to enable the flame kernel to efficiently grow and sufficiently improve the ignitability of the spark plug.

In the spark plug of the invention, preferably, the noble metal tip has a cylindrical columnar shape having a diameter ϕB of 0.3 mm or more and 1.0 mm or less. When the diameter ϕB of the noble metal tip is 1.0 mm or less, the discharge voltage is lowered, and the ignitability is further improved. In contrast, when the diameter ϕB of the noble metal tip is 0.3 mm or more, the durability of the noble metal tip can be improved.

DESCRIPTION OF REFERENCE NUMERALS AND SIGNS

Figure 1:
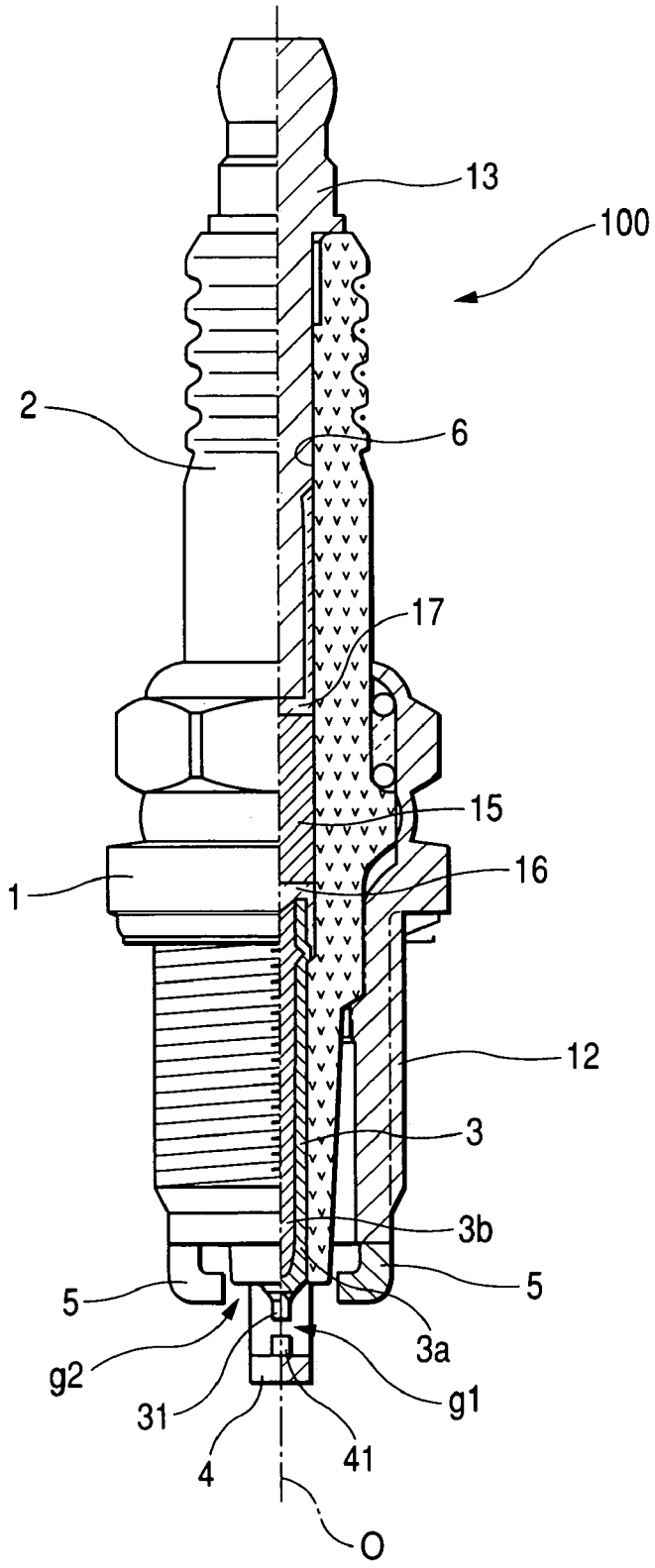
FIG. 1 is a front sectional view showing a spark plug 100 of the invention.

Reference numerals used to identify various structural elements in the drawings including the following.

1 metal shell
2 insulator
3 center electrode
4 first ground electrode
5 second ground electrode
6 through hole
31 first noble metal tip
41 second noble metal tip
100, 200, 300 spark plug

DETAILED DESCRIPTION OF THE INVENTION

Hereinafter, several embodiments of the invention will be described with reference to the accompanying drawings. However, the present invention should not be construed as being limited thereto.

Figure 2:
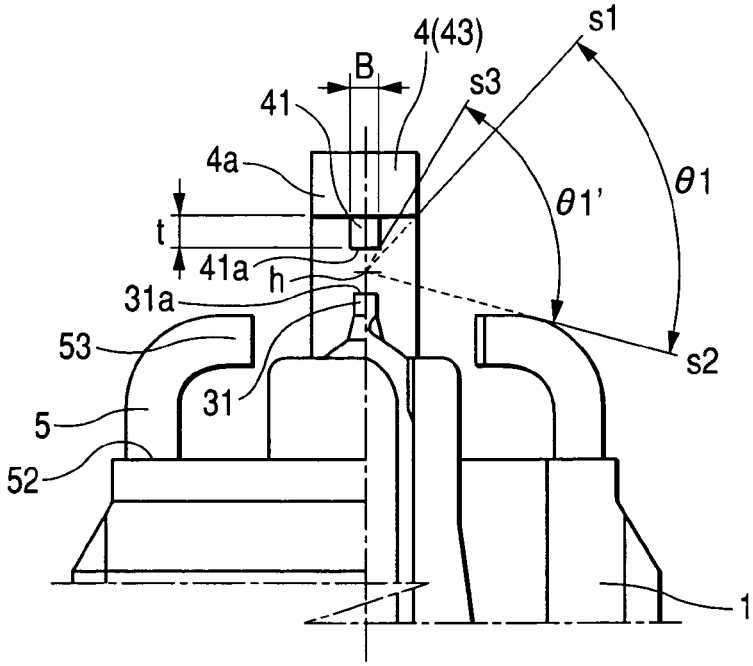
FIG. 2 is a front sectional view showing main portions of FIG. 1.

A resistor-containing spark plug 100 of Embodiment 1 of the invention is shown in FIGS. 1 and 2, and comprises: a cylindrical metal shell 1; an insulator 2 which is fitted into the metal shell 1 so that a tip end portion protrudes therefrom; a center electrode 3 which is disposed inside the insulator 2 while projecting a first noble metal tip 31 joined to the tip end side; a first ground electrode 4 which is placed so as to oppose the tip end face of the first noble metal tip 31 (the center electrode 3); and two second ground electrodes 5 which are disposed so as to oppose the center electrode 3 and the insulator 2. The second ground electrodes 5 are placed respectively in positions which are separated by 90° from the first ground electrode 4, and by 180° from each other. The second ground electrodes 5 are structured in the same manner. In the following description, therefore, only one of the second ground electrodes 5 will be described. The first ground electrode 4 is bent so that another end portion opposes the tip end face of the first noble metal tip 31 in a substantially parallel manner, and a second noble metal tip 41 is formed in a position opposing the first noble metal tip 31. A gap between the first noble metal tip 31 and the second noble metal tip 41 is formed as a first spark gap g1. A gap between the other end face of the second ground electrode 5 and the side peripheral face of the center electrode is formed as a second spark gap g2. In the second spark gap, spark discharge is generated in the form of creeping discharge along the surface of the insulator, and also in the form of aerial discharge through the air.

The metal shell 1 is made of carbon steel or the like. As shown in FIG. 1, a thread portion 12 for mounting the spark plug 100 to an engine block (not shown) is formed in the outer peripheral face of the metal shell. The insulator 2 is configured by a sintered body of ceramic such as alumina or aluminum nitride. A through hole 6 into which the center electrode 3 is to be fitted is formed inside the insulator along its axial direction. A terminal post 13 is fitted and fixed to one end side of the through hole 6, and the center electrode 3 is similarly fitted and fixed to the other end side. In the through hole 6, a resistor 15 is placed between the terminal post 13 and the center electrode 3. Conductive glass seal layers 16, 17 are disposed in the end portions of the resistor 15, and the ends are electrically connected to the center electrode 3 and the terminal post 13 via the conductive glass seal layers 16, 17, respectively.

An electrode base member 3*a* is formed in the surface in the center electrode 3, and a metal core 3*b* is inserted into the inner portion. The electrode base member 3*a* of the center electrode 3 is made of a Ni alloy such as INCONEL 600 (trademark of INCO Limited). By contrast, the metal core 3*b* is made of an alloy mainly containing Cu, Ag, and the like. The metal core 3*b* has a higher thermal conductivity than the electrode base member 3*a*. In the electrode base member 3*a* of the center electrode 3, the diameter of the tip end side is reduced, and the tip end face is flattened. A noble metal tip of a circular plate-like shape is placed on the tip end face, and a welded portion is formed along the outer edge of the joining face to fix the tip by laser welding, electron beam welding, resistance welding, or the like, thereby forming the first noble metal tip 31. The first noble metal tip 31 is made of a metal primarily containing Pt, Ir, or W. Specifically, Pt alloys such as Pt-20 wt % Ir and Pt-20 wt % Rh, and Ir alloys such as Ir-5 wt % Pt, Ir-20 wt % Rh, Ir-5 wt % Pt-1 wt % Rh-1 wt % Ni, and Ir-10 wt % Rh-5 wt % Ni are useful.

The first ground electrode 4 is configured by a first ground electrode body 4*a* and the second noble metal tip 41. In the first ground electrode body 4*a*, one end (not shown) is fixed to and integrated with the tip end face of the metal shell 1 by welding or the like. By contrast, the second noble metal tip 41 is disposed on the another end portion 43 of the first ground electrode body 4*a*. The second noble metal tip 41 is formed by disposing a cylindrical columnar noble metal tip in a predetermined position of the first ground electrode body 4*a*, and fixing the tip thereto by laser welding, electron beam welding, resistance welding, or the like. The second noble metal tip 41 is made of a metal primarily containing Pt, Ir, and W. Specifically, Pt alloys such as Pt-20 wt % M, Pt-20 wt % Rh, and Pt-20 wt % Rh-5 wt % Ni, and Ir alloys such as Ir-5 wt % Pt, Ir-20 wt % Rh, and Ir-11 wt % Ru-8 wt % Rh-1 wt % Ni are useful. An opposing face 41*a* of the second noble metal tip 41 opposes the tip end face of the center electrode (specifically, the tip end face 31*a* of the first noble metal tip 31). The first ground electrode body 4*a* is made of a Ni alloy such as INCONEL 600.

In the second noble metal tip 41 in Embodiment 1, the opposing face 41*a* has a diameter B of 0.7 mmϕ, and the tip protrudes from the first ground electrode body 4*a* by a protrusion amount t of 0.8 mm. In this configuration, the protrusion amount t by which the second noble metal tip 41 protrudes from the first ground electrode body 4*a* is 0.3 mm or more. Thus, when a flame kernel produced in the first discharge gap g1 which is formed by the first noble metal tip 31 and the second noble metal tip 41 grows as a result of swirling or the like, the possibility of the flame kernel making contact with the first ground electrode body 4*a* at an early stage is reduced. As such, growth of the flame kernel is expedited, whereby the ignitability is improved.

In Embodiment 1, since the diameter ϕB of the second noble metal tip 41 is 0.3 mm or more and 1.0 mm or less, the discharge voltage is lowered, the ignitability is improved, and the durability of the second noble metal tip 41 can be improved.

In the second ground electrode 5, one end is fixed to and integrated with the tip end face of the metal shell 1 by welding or the like. By contrast, the another end portion 53 of the second ground electrode 5 opposes the side peripheral faces of the center electrode and the insulator 2. The second ground electrode 5 is made of a Ni alloy containing 90 wt % or more of Ni.

A virtual line s1 passes through a middle point (h in FIG. 2) of the first discharge gap g1 on the axis O, and makes contact with the first ground electrode body 4*a*, and a virtual line s2 passes through the middle point h of the first discharge gap g1, and makes contact with an outer side face of the second ground electrode 5. In Embodiment 1, the included angle θ1 between the virtual line s1 and the virtual line s2 is θ1=65°. In this configuration where the included angle θ between the virtual lines s1 and s2 is θ≧55° (more preferably, θ≧60°), the gap between the first ground electrode body 4*a* and the second ground electrode 5 can be widened. During growth of a flame kernel produced in the vicinity of the middle point h of the first discharge gap g1, therefore, the occurrence of the flame kernel contacting with the second ground electrode 5 and the first ground electrode body 4*a* can be reduced, and it is possible to enable the flame kernel to efficiently grow. Consequently, it is possible to sufficiently improve the ignitability of the spark plug 100. When a virtual line s3 passing through the middle point h of the first discharge gap g1 and making contact with the second noble metal tip 41 is considered, the included angle θ1' between the virtual lines s2 and s3 is θ1'=76°. Since θ1' is 55° or more as described above, a structure in which the second noble metal tip 41 hardly impedes the growth of a flame kernel is obtained.

The spark plug 100 is produced in the following manner. In the following, description is made with placing emphasis on a method of producing main portions of the spark plug 100, and description of known components will be omitted.

First, alumina is used as a main raw material, and a sintering process is conducted at a high temperature to form the alumina into a predetermined shape, thereby forming the insulator 2. A steel member is used, and a plastic forming process is conducted to form the steel member into a predetermined shape, thereby forming the metal shell 1. In this process, a thread portion 12 is formed in the outer peripheral face of the tip end portion of the metal shell 1. Then, the rod-like center electrode 3, the first ground electrode body 4*a*, and the second ground electrode 5 which are made of a heat-resistant Ni alloy are formed. In forming the center electrode 3, the metal core 3*b* is inserted to form the electrode. The first ground electrode body 4*a* and the second ground electrode 5 are welded to the tip end face of the metal shell 1 by resistance welding. Thereafter, the second ground electrode 5 is bent toward a direction perpendicular to the axial direction by a known technique. In the center electrode 3, the diameter of the tip end portion is gradually reduced, and a noble metal tip is fixed to the tip end face by resistance welding, laser welding, or the like, thereby forming the first noble metal tip 31.

Then, the center electrode 3 is inserted into the through hole 6 of the insulator 2 so that the tip end side protrudes from the insulator 2. Next, the conductive seal layer 16, the resistor 15, and the conductive seal layer 17 are sequentially inserted into the rear end side, the terminal post 13 is inserted into the rear end side of the insulator 2 so that the rear end side of the terminal post 13 protrudes from the rear end of the insulator 2, and the terminal post is fixed thereto by a known technique. Then, the insulator 2 to which the center electrode 3, the terminal post 13, and the like are fixed is attached by a known technique to the metal shell 1 to which the first ground electrode body 4*a* and the second ground electrode 5 are fixed, while adjusting the second spark gap g2 between the center electrode and the second ground electrode 5. A noble metal tip is fixed to the another end portion 43 of the first ground electrode body 4*a* by resistance welding, laser welding, or the like, thereby forming the second noble metal tip 41. Thereafter, the first ground electrode 4 (the first ground electrode body 4*a*) is bent so that the opposing face 41*a* of the second noble metal tip 41 opposes the tip end face 31*a* of the first noble metal tip 31 of the center electrode 3 via the first discharge gap g1, thereby completing the spark plug 100 for an internal combustion engine shown in FIG. 1.

Next, Embodiment 2 of the invention will be described with reference to the accompanying drawings.

Figure 3:
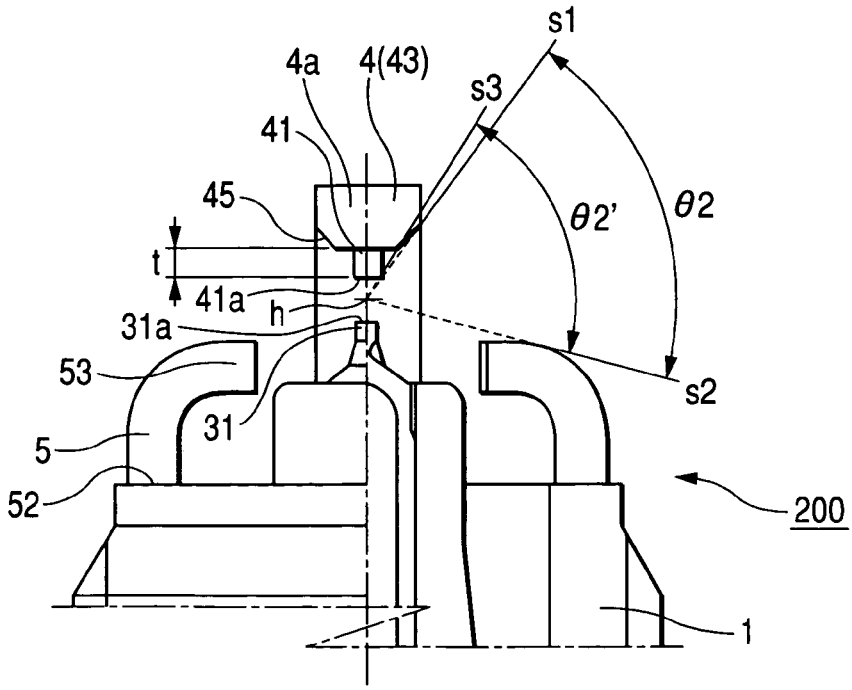
FIG. 3 is a front sectional view showing main portions of Embodiment 2 of the invention.
Figure 4:
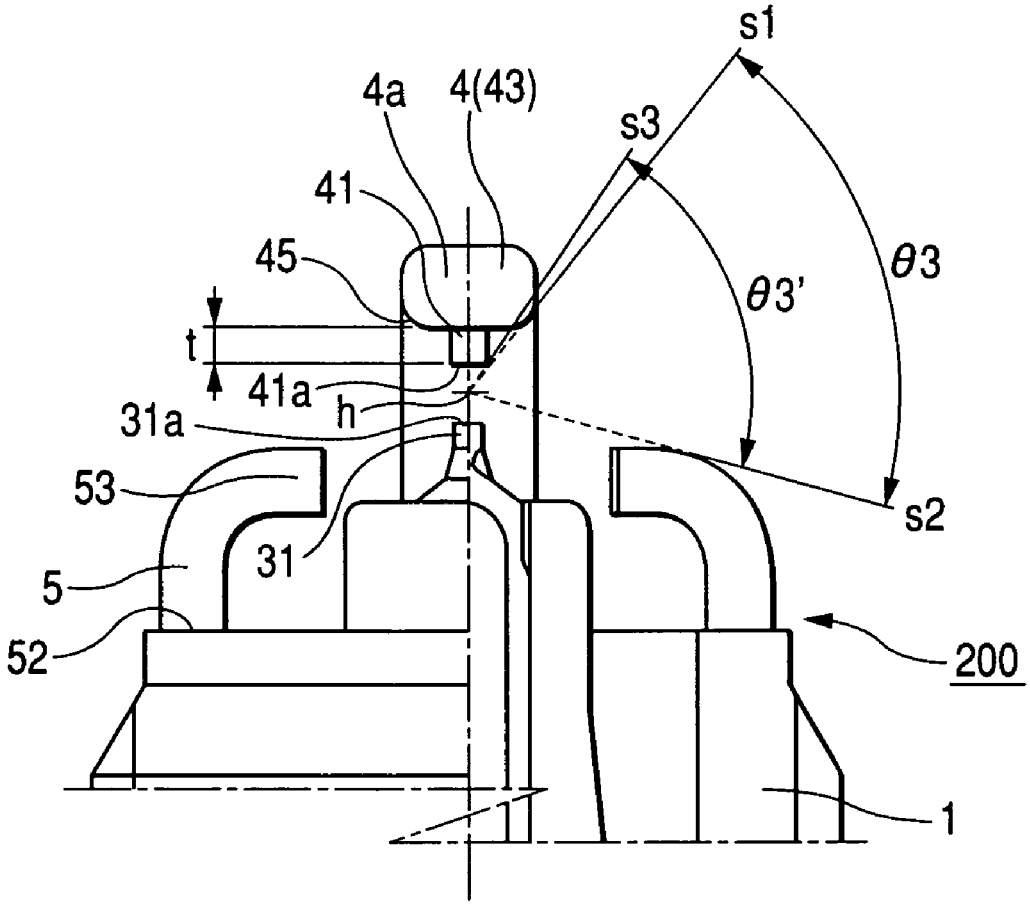
FIG. 4 is a front sectional view showing main portions of another example of FIG. 3.

A spark plug 200 shown in FIGS. 3 and 4 has a first ground electrode 4 which differs from the above-described spark plug 100. In FIGS. 3 and 4, components which are identical with those of FIG. 2 are denoted by the same reference numerals. The embodiment is configured in the same manner as Embodiment 1, except for the shape of the first ground electrode 4, and will be described with placing emphasis on the first ground electrode 4.

In the spark plug 200 of Embodiment 2, the first ground electrode body 4*a* is made of a Ni alloy such as INCONEL 600. In the first ground electrode body 4*a*, one end (not shown) is fixed to and integrated with the tip end face of the metal shell 1 by welding or the like. By contrast, the another end portion 43 of the first ground electrode body 4*a* opposes the tip end face 31*a* of the center electrode (specifically, the tip end face 31*a* of the first noble metal tip 31). A chamfered portion 45 is disposed in the outer peripheral edge of the inner side face of the another end portion 43. The chamfered portion 45 in Embodiment 2 may be formed by beveling as shown in FIG. 3, or by rounding the peripheral edge (round chamfering) as shown in FIG. 4. Alternatively, a shape which is obtained by cutting away the edges of the outer periphery of the inner side face may be employed. In the invention, the size of the chamfered portion 45 is set so that the portion in FIG. 3 has C of 0.5 mm, and that in FIG. 4 has R of 0.5 mm. In each of these configurations, when the virtual line s1 making contact with the first ground electrode body 4*a* in FIG. 3 or 4, and the virtual line s2 passing the middle point h of the first discharge gap g1 and making contact with an outer side face of the second ground electrode 5 are considered, the included angle θ2 or θ3 between the virtual line s1 and the virtual line s2 is θ2=70° or θ3=67°. When the chamfered portion 45 is formed at least in the outer peripheral edge of the inner side face in the first ground electrode body 4*a* as described above, the distance between the first ground electrode body 4*a* and the second ground electrode 5 can be further increased. During growth of a flame kernel produced in the vicinity of the middle point h of the first discharge gap g1, therefore, the occurrence of the flame kernel contacting the first ground electrode body 4*a* can be reduced, and it is possible to enable the flame kernel to efficiently grow. When, in FIG. 3 or 4, the virtual line s3 passing through the middle point h of the first discharge gap g1 and making contact with the second noble metal tip 41 is considered, the included angle θ2' or θ3' between the virtual lines s2 and s3 is θ2'=71° or θ3'=73°. Since θ2' or θ3' is 55° or more as described a structure in which the second noble metal tip 41 hardly impedes the growth of a flame kernel is obtained.

Next, Embodiment 3 of the invention will be described with reference to the accompanying drawings.

Figure 5A:
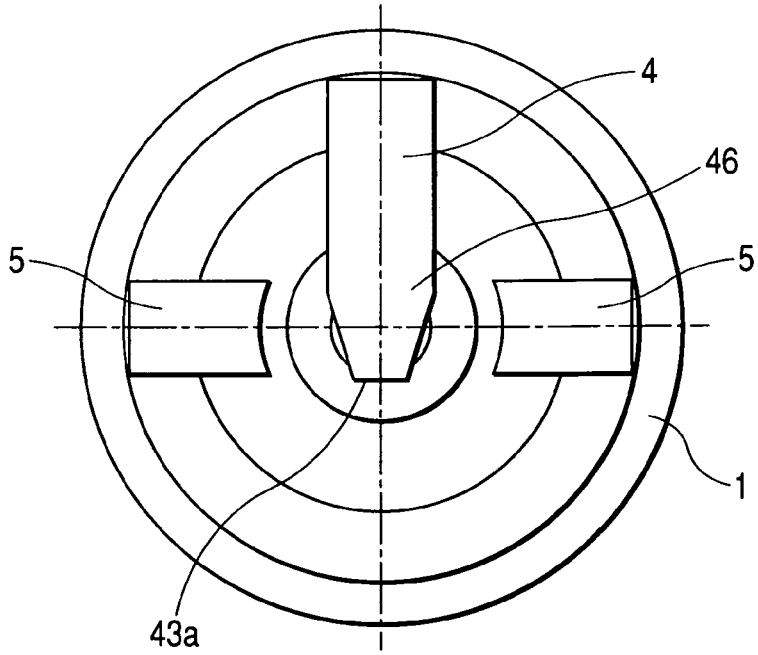
FIG. 5(A) is a plan view and FIG. 5(B) is a front sectional view showing main portions of Embodiment 3 of the invention.
Figure 5B:
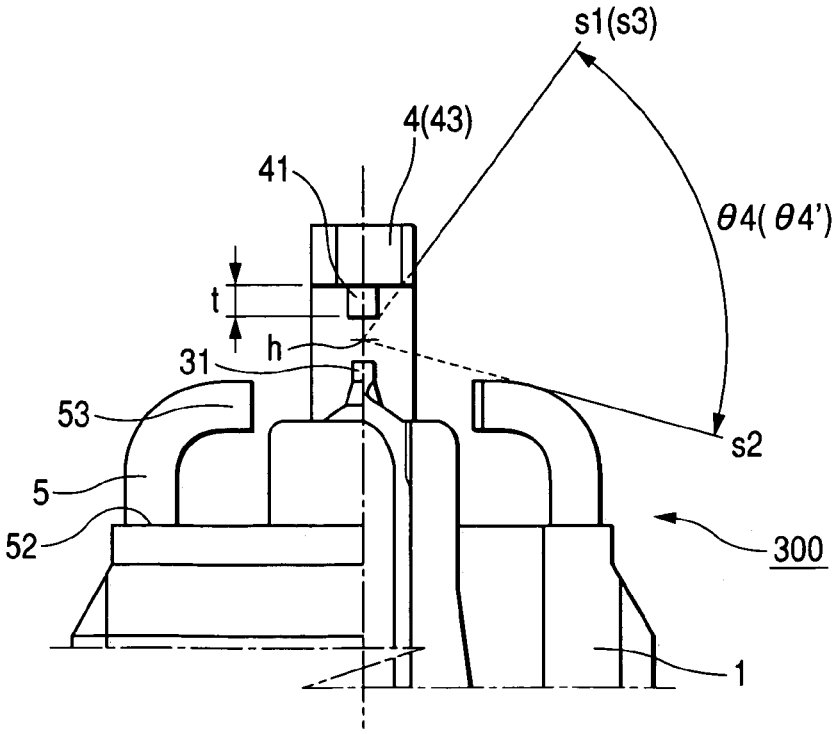

A spark plug 300 shown in FIG. 5 (FIGS. 5(A) and 5(B)) has a first ground electrode 4 which differs from the above-described spark plug 100. In FIG. 5, the components which are identical with those of FIG. 2 are denoted by the same reference numerals. The embodiment is configured in the same manner as Embodiment 1, except for the shape of the first ground electrode 4, and will be described with placing emphasis on the first ground electrode 4.

In the spark plug 300 of Embodiment 3, the first ground electrode body 4*a* is made of a Ni alloy such as INCONEL 600. In the first ground electrode body 4*a*, the one end (not shown) is fixed to and integrated with the tip end face of the metal shell 1 by welding or the like. By contrast, the another end portion 43 of the first ground electrode body 4*a* opposes the tip end face 31*a* of the center electrode (specifically, the tip end face 31*a* of the first noble metal tip 31). The another end portion 43 of the first ground electrode body 4*a* decreases in sectional size as it advances toward the another end face 43*a* (in this embodiment, formed as a tapered shape). In this configuration, when the virtual line s1 making contact with the first ground electrode body 4*a* in FIG. 5, and the virtual line s2 passing through the middle point h of the first discharge gap g1 and making contact with an outer side face of the second ground electrode 5 are considered, the included angle θ4 between the virtual line s1 and the virtual line s2 is θ4=70°. Namely, the distance between the first ground electrode body 4*a* and the second ground electrode 5 can be further increased. During growth of a flame kernel produced in the vicinity of the middle point h of the first discharge gap g1, therefore, the occurrence of the flame kernel contacting the first ground electrode body 4*a* can be reduced, and it is possible to enable the flame kernel to efficiently grow. When, in FIG. 5, the virtual line s3 passing through the middle point h of the first discharge gap g1 and making contact with the second noble metal tip 41 is considered, the included angle θ4' between the virtual lines s2 and s3 is θ4'=70°. Since θ4' is 55° or more as described above, a structure in which the second noble metal tip 41 hardly impedes the growth of a flame kernel is obtained.

EXAMPLES

In order to demonstrate the effects of the invention, the following various experiments were conducted. However, the present invention should not be construed as being limited thereto.

Various samples of the spark plug having the shape shown in FIGS. 1 and 2 were prepared in the following manner. First, sintered alumina ceramic was selected as the material of the insulator 2, INCONEL 600 as the electrode base member 3*a* of the center electrode 3, a copper core as the metal core 3*b*, INCONEL 600 as the first ground electrode body 4*a*, a heat-resistant Ni alloy (an alloy of Ni-90 wt % Ni) as the second ground electrode 5, Ir-20 wt % Rh as the material of the first noble metal tip 31, and Pt-20 wt % Ni as that of the second noble metal tip 41. The first noble metal tip 31 was formed as a cylindrical columnar shape having a diameter ϕ of 0.6 mm, and the second noble metal tip 41 was formed as a cylindrical columnar shape having a height t of 0.8 mm and a diameter ϕ of 0.6 mm. The first ground electrode body 4*a* was set to have a width of 2.5 mm and a height of 1.4 mm, and the second ground electrode 5 was set to have a width of 2.2 mm and a height of 1.2 mm. The size of the first discharge gap g1 is 1.1 mm.

Spark plugs 100 in which the angle θ1 (in the table, θ) in FIG. 2 was set to 46°, 52°, 55°, 60°, 65°, 70°, and 72° were mounted in a six-cylinder DOHC gasoline engine having a 2,000 cc displacement. Under operation conditions corresponding to 60 km/h (engine revolutions: 2,000 rpm), an ignitability test was conducted. In this test, discharging was conducted 1,000 times in the first discharge gap under the above engine conditions, and the value of A/F when misfiring occurred ten times was defined as the ignition limit. Results are shown in FIG. 7.

Figure 7:
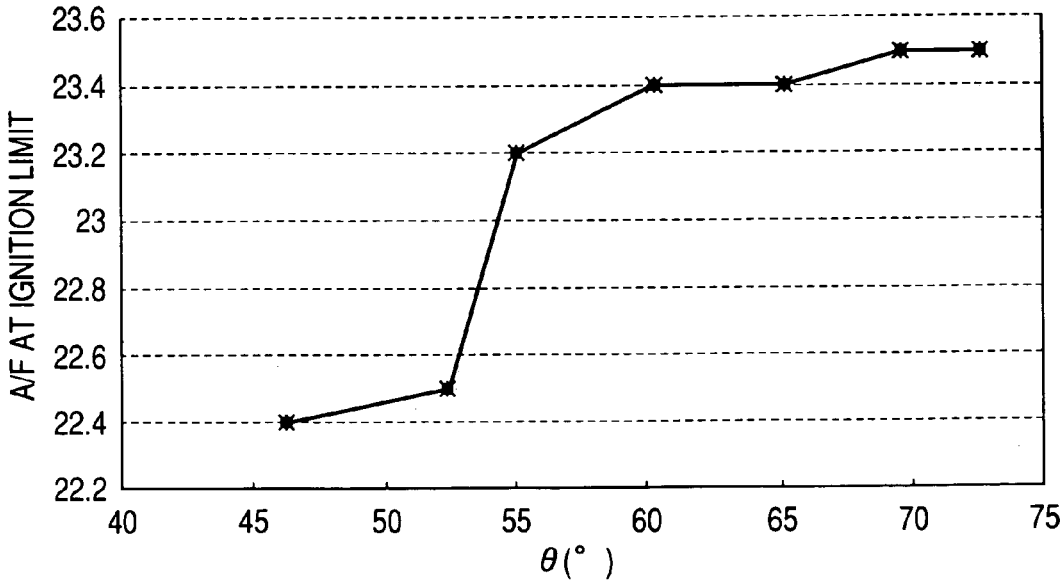
FIG. 7 is a graph showing A/F at ignition limit as a function of the included angle θ(°) as determined in the Examples.

As seen from FIG. 7, A/F was 22.4 in the case where the angle θ1 was 46°, A/F was 22.5 in the case where the angle θ1 was 52, A/F was 23.2 in the case where the angle θ1 was 55°, A/F was 23.4 in the case where the angle θ1 was 60°, A/F was 23.4 in the case where the angle θ1 was 65°, A/F was 23.5 in the case where the angle θ1 was 70°, and A/F was 23.5 in the case where the angle θ1 was 72°. When θ1 is 55° or more, A/F is 23.2, and the ignitability is suddenly improved. When θ1 is increased or set to 60°, A/F is 23.4, and the ignitability is further improved.

The invention is not restricted to the above-described specific embodiments, and may be realized in embodiments which are variously modified in accordance with the purpose and use within the scope of the invention.

In the spark plug 100 of the invention, for example, the metal core 3*b* is inserted into only the center electrode 3. The invention is not restricted to this configuration. Another metal core may be inserted into one of the first ground electrode body 4*a* and the second ground electrode 5. In this case, the material of the metal core is a single metal such as Cu or Ag, or an alloy.

Figure 6:
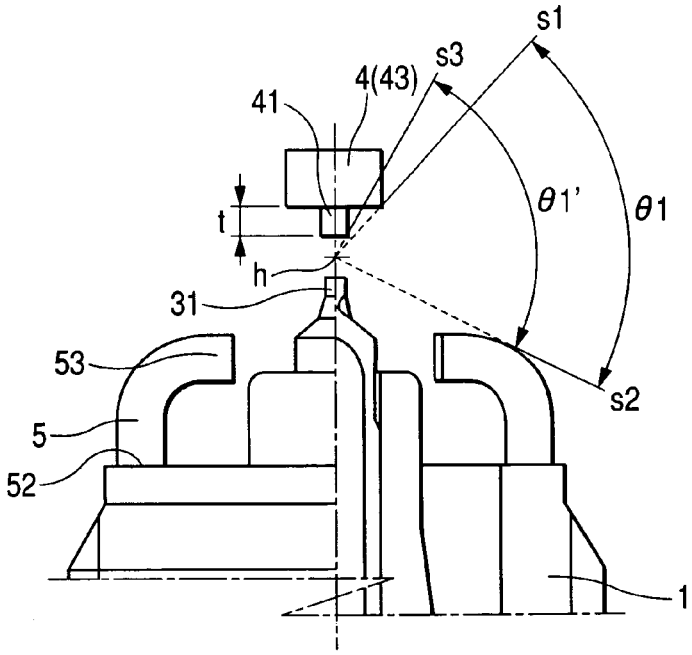
FIG. 6 is a front sectional view showing another example of Embodiment 1.

The spark plug 100 of the invention comprises the two second ground electrodes 5. The invention is not restricted to this configuration. The spark plug may comprise only one second ground electrode, or three or more second ground electrodes. The spark plug 100 of the invention has the shape in which only the tip end portion of the center electrode 3 protrudes from the insulator 2. Alternatively, the basal portion of the center electrode 3 may protrude from the insulator 2 as shown in FIG. 6. In the alternative, the distance between the first discharge gap g1 and the second ground electrode 5 can be made larger. Hence, the between the first ground electrode body 4*a* and the second ground electrode 5 can be made larger, so that the ignitability is further improved.

This application is based on Japanese Patent application JP 2003-422770, filed Dec. 19, 2003, the entire content of which is hereby incorporated by reference, the same as if set forth at length.

What is claimed is:

1. A spark plug comprising:

an insulator having an axial hole in an axial direction of said spark plug;

a center electrode disposed in a tip end side of said axial hole of said insulator;

a metal shell surrounding said insulator;

a first ground electrode including a first ground electrode body having one end joined to said metal shell, and a noble metal tip joined to an inner side face of another end portion of said first ground electrode body and disposed opposite a tip end face of said center electrode across a first discharge gap; and a second ground electrode having one end bonded to said metal shell, and another end disposed opposite a side peripheral face of said center electrode or a side peripheral face of said insulator across a second discharge gap, wherein a distance in an axial direction between an opposing face of said noble metal tip which opposes said tip end face of said center electrode, and said inner side face of said first ground electrode body is 0.3 mm or more, and in a virtual section which passes through a center of gravity of said second ground electrode and which contains an axis of said spark plug, an included angle θ between a virtual line s1 and a virtual line s2 satisfies the following relationship:

$$\theta \geqq 55°,$$

the virtual line s1 passing through a middle point of said first discharge gap on said axis and making contact with an edge of said first ground electrode body which is closest to the second ground electrode, the virtual line s2 passing through said middle point of said first discharge gap and making contact with an outer side face of said second ground electrode.

2. The spark plug as claimed in claim 1, wherein the included angle θ between virtual line s1 and virtual line s2 is $$\theta \geqq 60°.$$

3. The spark plug as claimed in claim 1, wherein said first ground electrode body has a chamfered portion, and said virtual line s1 contacts an outer peripheral edge of the inner side face of said chamfered portion.

4. The spark plug as claimed in claim 1, wherein said virtual line s1 contacts the another end portion of the first ground electrode body, the first ground electrode decreasing in sectional size as it advances toward the another end.

5. The spark plug as claimed in claim 1, wherein in the virtual section, an included angle θ between a virtual line s3 and the virtual line s2 satisfies the following relationship:

$$\theta \geqq 55°,$$

the virtual line s3 passing through a middle point of said first discharge gap on an axis and making contact with said noble metal tip.

6. The spark plug as claimed in claim 5, wherein the included angle θ between virtual line s3 and virtual line s2 is $\theta \geqq 60°$.

7. The spark plug as claimed in claim 1, wherein said noble metal tip has a cylindrical columnar shape and has a diameter of from 0.3 to 1.0 mm.

8. The spark plug as claimed in claim 1, wherein $\theta \leqq 90°$.

9. A spark plug comprising:

an insulator having an axial hole in an axial direction of said spark plug;

a center electrode disposed in a tip end side of said axial hole of said insulator;

a metal shell surrounding said insulator;

a first ground electrode including a first ground electrode body having one end joined to said metal shell, and a noble metal tip joined to an inner side face of another end portion of said first ground electrode body and disposed opposite a tip end face of said center electrode across a first discharge gap; and a second ground electrode having one end bonded to said metal shell, and another end disposed opposite a side peripheral face of said center electrode or a side peripheral face of said insulator across a second discharge gap, wherein a distance in an axial direction between an opposing face of said noble metal tip which opposes said tip end face of said center electrode, and said inner side face of said first ground electrode body is 0.3 mm or more, and in a virtual section which passes through a center of gravity of said second ground electrode and which contains an axis of said spark plug, an included angle θ between a virtual line s1 and a virtual line s2 satisfies the following relationship:

$$90° \geqq \theta \geqq 55°,$$

the virtual line s1 passing through a middle point of said first discharge gap on said axis and making contact with said first ground electrode body, the virtual line s2 passing through said middle point of said first discharge gap and making contact with an outer side face of said second ground electrode.

* * * * *